US011560641B2

(12) United States Patent
Hasegawa et al.

(10) Patent No.: US 11,560,641 B2
(45) Date of Patent: Jan. 24, 2023

(54) SURFACE-TREATED ALUMINUM MATERIAL HAVING EXCELLENT ADHESIVENESS TO RESINS, METHOD FOR MANUFACTURING THE SAME, AND SURFACE-TREATED ALUMINUM MATERIAL-RESIN BONDED BODY

(71) Applicant: UACJ CORPORATION, Tokyo (JP)

(72) Inventors: Shinichi Hasegawa, Tokyo (JP); Tatsuya Mimura, Tokyo (JP); Yukio Honkawa, Tokyo (JP); Toshiki Maezono, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 0 days.

(21) Appl. No.: 15/751,409

(22) PCT Filed: Aug. 8, 2016

(86) PCT No.: PCT/JP2016/073351
§ 371 (c)(1),
(2) Date: Feb. 8, 2018

(87) PCT Pub. No.: WO2017/026461
PCT Pub. Date: Feb. 16, 2017

(65) Prior Publication Data

US 2018/0230618 A1 Aug. 16, 2018

(30) Foreign Application Priority Data

Aug. 13, 2015 (JP) ..... JP2015-159748
Jul. 26, 2016 (JP) ..... 2016-145908

(51) Int. Cl.
*C25D 11/06* (2006.01)
*C25D 11/02* (2006.01)
(Continued)

(52) U.S. Cl.
CPC ..... *C25D 11/06* (2013.01); *C25D 11/024* (2013.01); *C25D 11/18* (2013.01); *C25D 11/24* (2013.01)

(58) Field of Classification Search
CPC ..... C25D 11/024
See application file for complete search history.

(56) References Cited

U.S. PATENT DOCUMENTS 2,883,045 A * 4/1959 Abramson ..... B65D 85/672 206/396
4,483,751 A * 11/1984 Murayama ..... C25D 11/02 174/256
(Continued)

FOREIGN PATENT DOCUMENTS

CN 103403229 A 11/2013
CN 104114752 A 10/2014
(Continued)

OTHER PUBLICATIONS

English language translation of JP 2009-228064 A, generated on Nov. 7, 2019 with the Japanese Platform for Patent Information Website (https://www.j-platpat.inpit.go.jp/).*
(Continued)

*Primary Examiner* — Mark Ruthkosky
*Assistant Examiner* — Julia L Rummel
(74) *Attorney, Agent, or Firm* — Greer, Burns & Crain, Ltd.

(57) ABSTRACT

The present disclosure provides a surface-treated aluminum material having excellent adhesiveness to resins, on the surface of which an oxide film is formed, the oxide film comprising a surface-side porous aluminum oxide film having a thickness of 20 to 500 nm and a base-side barrier aluminum oxide film having a thickness of 3 to 30 nm, wherein small pores each having a diameter of 5 to 30 nm are formed on the porous aluminum oxide film, and the
(Continued)

length of cracks formed in a boundary between the porous aluminum oxide film and the barrier aluminum oxide film is not more than 50% of the length of the boundary, a method for manufacturing the surface-treated aluminum material, and a surface-treated aluminum material-resin bonded body, comprising the surface-treated aluminum material and a resin that covers the surface of the oxide film formed thereon.

3 Claims, 1 Drawing Sheet

(51) Int. Cl.
*C25D 11/18* (2006.01)
*C25D 11/24* (2006.01)

(56) References Cited

U.S. PATENT DOCUMENTS

2006/0143920 A1* 7/2006 Morrison ..... B32B 15/20 29/896.6
2011/0192451 A1* 8/2011 Sato ..... H01L 31/0392 136/252

FOREIGN PATENT DOCUMENTS

| | | | | |
|---|---|---|---|---|
| EP | 2660362 | A1 | | 11/2013 |
| JP | 2006322067 | A | | 11/2006 |
| JP | 2009228064 | A | * | 10/2009 |
| JP | 2010000679 | A | * | 1/2010 |
| JP | 2011021260 | A | | 2/2011 |
| JP | 2013170288 | A | | 9/2013 |
| TW | 201348517 | A | | 12/2013 |
| WO | 2013118870 | A1 | | 8/2013 |
| WO | 2015015768 | A1 | | 2/2015 |

OTHER PUBLICATIONS

English language translation of JP 2010-000679 A, generated on Nov. 7, 2019 with the Japanese Platform for Patent Information Website (https://www.j-platpat.inpit.go.jp/).*
Int'l. Search report issued in Int'l. App. No. PCT/JP2016/073351, dated Aug. 30, 2016.
Aluminium Handbook, 7th edition, pp. 179-190, 2007, Japan Aluminium Association.
Japanese Industrial Standards: JIS H8601, "Anodic oxide coatings on aluminium and aluminium alloys"; (1999).
Chinese office action issued in Chinese Patent Application No. 201680035520.3, dated Dec. 20, 2018 (with translation).
Office action dated Dec. 24, 2019 issued in corresponding Taiwanese patent application No. 105125847 (with translation).

* cited by examiner

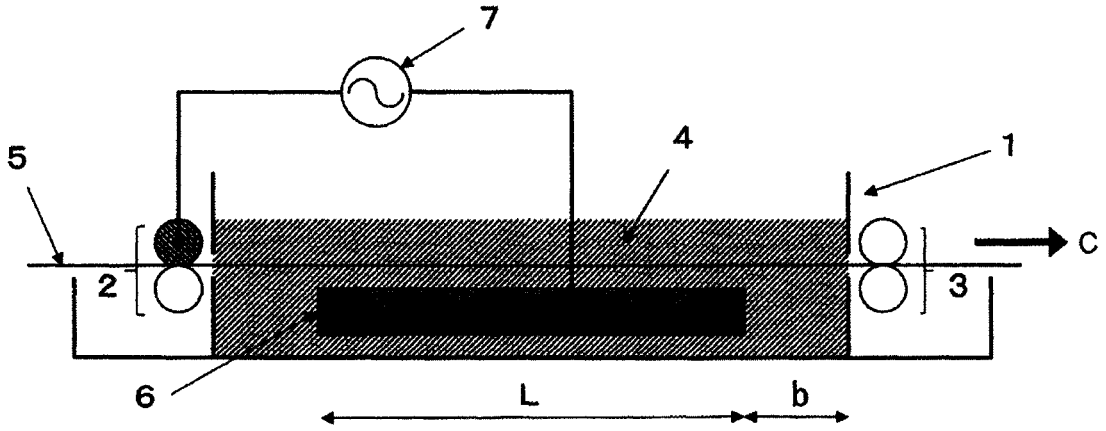
7
5
4
1
C
2
3
6
L
b

SURFACE-TREATED ALUMINUM MATERIAL HAVING EXCELLENT ADHESIVENESS TO RESINS, METHOD FOR MANUFACTURING THE SAME, AND SURFACE-TREATED ALUMINUM MATERIAL-RESIN BONDED BODY

This is a National Phase Application filed under 35 U.S.C. § 371, of International Application No. PCT/JP2016/073351, filed Aug. 8, 2016, the contents of which are incorporated by reference.

TECHNICAL FIELD

The present disclosure relates to a surface-treated aluminum material and a method for manufacturing the surface-treated aluminum material. Specifically, the present disclosure relates to a surface-treated aluminum material excellent in adhesiveness to resins having a aluminum oxide film on its surface and a method for stably manufacturing the surface-treated aluminum material. The present disclosure further relates to a bonded body of the surface-treated aluminum material and a resin.

BACKGROUND ART

Pure aluminum material or aluminum alloy material (hereinafter referred to as "aluminum material") is lightweight and has adequate mechanical properties, and it also has excellent characteristics in terms of aesthetics, molding processability, corrosion resistance, and the like. Therefore, it is widely used for a variety of containers, constructional materials, mechanical parts, and the like. Such aluminum material may be used directly. Alternatively, it is often used after being treated by a variety of surface treatment in order to add or improve functions regarding corrosion resistance, abrasion resistance, adhesiveness to resins, hydrophilicity, water repellency, antibacterial activity, design, infrared emission, high reflectivity, and the like.

For example, anode oxidation treatment (so-called alumite treatment) is widely used as a method for improving corrosion resistance and abrasion resistance. Specifically, as disclosed in Non Patent Literature 1 and 2, various treatment methods comprising immersing an aluminum material in an acidic electrolyte and conducting direct-current electrolytic treatment so as to form an anode oxide film having a thickness of several to several tens of micrometers on the aluminum material surface have been suggested depending on the intended use.

In addition, the method for alkali alternating-current electrolysis disclosed in Patent Literature 1 is suggested as a method for surface treatment particularly for the improvement of adhesiveness to resins. In other words, an oxide film comprising a surface-side porous aluminum oxide film having a thickness of 20 to 500 nm and a base-side barrier aluminum oxide film having a thickness of 3 to 30 nm is formed on the surface of an aluminum material. Small pores each having a diameter of 5 to 30 nm are formed on the porous aluminum oxide film, and the range of variation in the total thickness of the porous aluminum oxide film and the barrier aluminum oxide film over the entire surface of the aluminum material falls within a range of ±50% of the arithmetic mean value of the total thickness. Specifically, the above oxide film can be obtained by using an electrode made of an aluminum material and a counter electrode and conducting alternating-current electrolytic treatment in an alkaline aqueous solution at a pH of 9 to 13, a solution temperature of 35 to 80° C., and a dissolved aluminum concentration of 5 ppm to 1000 ppm, which is used as an electrolyte solution, under conditions of a frequency of 20 to 100 Hz, a current density of 4 to 50 A/dm$^2$, and a period of electrolysis time of 5 to 60 seconds.

However, in recent years, it has been found that even if treatment is conducted using the technique disclosed in Patent Literature 1 under the same electrolysis conditions, adhesiveness to resins is not necessarily improved depending on the manufacturing facility configuration. Specifically, when an elongated aluminum material such as an aluminum plate rolled into a coil or a long extruded aluminum bar is treated by the above electrolytic treatment, adhesiveness to resins may not be exhibited when so-called continuous treatment is conducted, during which the current is always allowed to pass between an aluminum material and a counter electrode for the improvement of productivity and the aluminum material is continuously fed and supplied into an electrolyzer.

CITATION LIST

Non Patent Literature

Non Patent Literature 1: Aluminum Handbook, 7th edition, pp. 179 to 190, 2007, Japan Aluminum Association Non Patent Literature 2: Japanese Industrial Standards: JIS H8601; "Anodic oxide coatings on aluminium and aluminium alloys" (1999)

Patent Literature

Patent Literature 1: International Publication No. WO 2013/118870

SUMMARY OF INVENTION

Technical Problem

The present disclosure has been made in consideration of the above circumstances. An object of the present disclosure is to provide a surface-treated aluminum material excellent in adhesiveness to resins and a method for manufacturing the surface-treated aluminum material mainly when a long aluminum material is treated by continuous treatment, and a bonded body of such surface-treated aluminum material and a resin.

Solution to Problem

As a result of intensive studies in order to achieve the above object, the present inventors found that the reason why adhesiveness to resins of an aluminum material treated by continuous treatment is not necessarily improved is that the adhesiveness to resins is influenced by the electrolytic current behavior in the aluminum material after the termination of electrolysis. Specifically, the present inventors found that adhesiveness to resins declines when an aluminum material is exposed to an environment in which the current in the aluminum material gradually attenuates for a long period of time while the aluminum material is electrolyzed under conditions specified in, for example, Patent Literature 1, and removed from an electrolyzer. This case tends to occur especially when electrolysis is conducted during continuous treatment. As a result of further studies by the present inventors, the present disclosure has been completed.

In other words, the present disclosure defines a surface-treated aluminum material having excellent adhesiveness to resins, on the surface of which an oxide film is formed, the oxide film comprising a surface-side porous aluminum oxide film having a thickness of 20 to 500 nm and a base-side barrier aluminum oxide film having a thickness of 3 to 30 nm, wherein small pores each having a diameter of 5 to 30 nm are formed in the porous aluminum oxide film, and the length of cracks formed in a boundary between the porous aluminum oxide film and the barrier aluminum oxide film accounts for not more than 50% of the length of the boundary.

In addition, the present disclosure defines a method for manufacturing the surface-treated aluminum material having excellent adhesiveness to resins according to claim 1, comprising conducting alternating-current electrolytic treatment using an electrode made of an aluminum material that is continuously fed and supplied into an electrolyte solution and a fixed counter electrode, the electrolyte solution being an alkaline aqueous solution having a pH of 9 to 13 at a solution temperature of 35 to 85° C., under conditions of a frequency of 10 to 100 Hz, a current density of 4 to 50 $A/dm^2$, and a period of electrolysis time of 5 to 300 seconds, thereby forming an oxide film on the surface of a portion of the aluminum material opposed to the counter electrode, wherein the electrode made of an aluminum material and the counter electrode are continuously energized, and time required for the current density in the electrolytically treated aluminum material portion to reach below 1 $A/dm^2$ after the elapse of the electrolysis time is set to not more than 10.0 seconds.

The present disclosure defines that an interelectrode distance between the electrode made of the aluminum material and the counter electrode is 2 to 150 mm.

Further, the present disclosure defines a surface-treated aluminum material-resin bonded body, comprising the surface-treated aluminum material comprising a surface-treated aluminum material having excellent adhesiveness to resins, on the surface of which an oxide film is formed, the oxide film comprising a surface-side porous aluminum oxide film having a thickness of 20 to 500 nm and a base-side barrier aluminum oxide film having a thickness of 3 to 30 nm, wherein small pores each having a diameter of 5 to 30 nm are formed in the porous aluminum oxide film, and the length of cracks formed in a boundary between the porous aluminum oxide film and the barrier aluminum oxide film accounts for not more than 50% of the length of the boundary and a resin that covers the surface of the oxide film formed on the surface-treated aluminum material.

Advantageous Effects of Invention

According to the present disclosure, an oxide film having high adhesion to a resin or the like is formed on the surface of an aluminum material, thereby making it possible to continuously obtain a surface-treated aluminum material excellent in adhesiveness to resins. Further, a bonded body of such surface-treated aluminum material and a resin exhibits excellent adhesion.

Specifically, the oxide film on the surface of the aluminum material has a two-layer structure comprising a porous aluminum oxide film and a barrier aluminum oxide film. In addition, a surface-side porous aluminum oxide film having a thickness of 20 to 500 nm and small pores each having a diameter of 5 to 30 nm formed on the aluminum material can prevent cohesive failure from occurring therein and increase its area so as to improve adhesion to a material such as a resin, to which it binds. Moreover, a base-side barrier aluminum oxide film having a thickness of 3 to 30 nm formed on the aluminum material can prevent cohesive failure from occurring therein and bind the aluminum serving as a base and the porous aluminum oxide film so as to improve adhesiveness and adhesion. In such case, the length of cracks formed in a boundary between the porous aluminum oxide film and the barrier aluminum oxide film is maintained to be not more than 50% of the boundary length such that it is possible to prevent cohesive failure from occurring in the oxide film itself.

BRIEF DESCRIPTION OF DRAWING

FIG. 1 is a schematic view of a facility for manufacturing the aluminum material according to the present disclosure.

DESCRIPTION OF EMBODIMENTS

The present disclosure is described in detail below. An oxide film is formed on the surface of the surface-treated aluminum material according to the present disclosure. This oxide film includes a surface-side porous aluminum oxide film and a base-side barrier aluminum oxide film. In addition, small pores are formed in the porous aluminum oxide film.

A. Aluminum Material

Pure aluminum (for example, not less than 99.0 mass %) or an aluminum alloy is used as an aluminum material in the present disclosure. Components of an aluminum alloy are not particularly limited. A variety of alloys such as JIS-defined alloys can be used. The shape of such alloy is not particularly limited; however, in order to conduct continuous treatment as described below, a long aluminum material such as a aluminum plate rolled into a coil or a long extruded aluminum bar is preferably used. In addition, the plate thickness of an aluminum plate may be appropriately determined depending on the intended use. From the viewpoints of weight saving and formability, the plate thickness is preferably 0.05 to 2.0 mm and more preferably 0.1 to 1.0 mm.

B. Manufacturing Method

Specifically, according to the present disclosure, it is possible to provide a method comprising conducting alternating-current electrolytic treatment using an electrode made of an aluminum material that is continuously fed and supplied into an electrolyte solution and a fixed counter electrode, the electrolyte solution being an alkaline aqueous solution having a pH of 9 to 13 at a solution temperature of 35 to 85° C., under conditions of a frequency of 10 to 100 Hz, a current density of 4 to 50 $A/dm^2$, and a period of electrolysis time of 5 to 300 seconds, thereby forming an oxide film on the surface of a portion of the aluminum material opposed to the counter electrode, wherein the electrode made of an aluminum material and the counter electrode are continuously energized, and time required for the current density in the portion of the electrolytically treated aluminum material to reach below 1 $A/dm^2$ after the elapse of the electrolysis time is set to not more than 10.0 seconds.

For example, a long aluminum plate material 1, which is wound into a coil, can be used as the aluminum material that is continuously fed and supplied into an electrolyte solution. Examples of the above method include: a method comprising unwinding such a coil to immersing the aluminum material in an electrolyzer, conducting electrolytic treatment, and rewinding the electrolytically treated aluminum plate material outside the electrolyzer; and a method comprising feeding a long aluminum bar such as an extruded material or a drawn material, immersing the fed long aluminum bar in an electrolyzer, conducting electrolytic treatment, and taking the electrolytically treated long aluminum material out of the electrolyzer. Specifically, as exemplified in FIG. 1, a pair of rolls 2 and a pair of rolls 3 are arranged at the forward position for feeding into an electrolyzer 1 and the backward position for feeding out of the electrolyzer, respectively, in order to allow an aluminum material 5 to pass through an electrolyte solution 4. Prior to electrolytic treatment, the aluminum material 5 wound into a coil, which is not illustrated, is unwound and fed to be supplied into the electrolyte solution 4 via the pair of rolls 2 at the forward position of the electrolyzer 1. Meanwhile, the electrolytically treated aluminum material 5 is rewound into a coil via the pair of rolls 3 at the backward position of the electrolyzer 1 being rolled by a roll, which is not illustrated. In addition, a counter electrode 6 is arranged in the electrolyte solution 4 so that it is opposed to a portion of the aluminum material 5 being fed. It is preferable to dispose the surface of the aluminum material 5 and the face of the counter electrode 6, which is opposed to the surface, in parallel to each other. It is also possible to electrolytically treat both faces of the aluminum material 5 in an efficient manner by arranging the counter electrode 6 in both sides of the aluminum material 5. The aluminum material 5 is connected to an alternator 7 via the pair of rolls 2. In addition, the electrode corresponding to the aluminum material 5 and the counter electrode 6 are continuously energized by the alternator 7.

Further the aluminum material 5 and the counter electrode 6 may be arranged in a manner such that the both are positioned horizontally, positioned with a tilt with respect to the horizon, or positioned vertically. Furthermore, the interelectrode distance between the electrode corresponding to the aluminum material 5 and the counter electrode 6 is preferably 2 to 150 mm and more preferably 5 to 100 mm. When the interelectrode distance is less than 2 mm, a gap between the electrode corresponding to the aluminum material 5 and the counter electrode 6 becomes too narrow, which may cause spark generation. In addition, it becomes difficult to allow gas bubbles generated in the vicinity of the gap to be scattered, which may result in unevenness on the plate surface. When the interelectrode distance exceeds 150 mm, solution convection generated between the electrode corresponding to the aluminum material 5 and the counter electrode 6 becomes less influential during feeding of the aluminum material 5, which may cause a significant delay in the rate of electrolysis film formation.

Examples of an alkaline aqueous solution that can be used as an electrolyte solution in the alternating-current electrolytic treatment step include: phosphates such as sodium phosphate, potassium hydrogen phosphate, sodium pyrophosphate, potassium pyrophosphate and sodium metaphosphate; alkali metal hydroxides such as sodium hydroxide and potassium hydroxide; carbonates such as sodium carbonate, sodium hydrogen carbonate, and potassium carbonate; ammonium hydroxide; and an aqueous solution of a mixture thereof. As it is necessary to maintain pH of the electrolyte solution as explained below, it is preferable to use an alkaline aqueous solution containing a phosphate substance, which is expected to have the buffering effect. The concentration of such alkaline component is adjusted so that pH of the electrolyte solution is set to a desirable level. In general, it is preferably $1\times10^{-4}$ to 1 mol/L and more preferably $1\times10^{-3}$ to 0.8 mol/L. In addition, in order to enhance the ability to remove contaminant components, a surfactant may be added into the alkaline aqueous solution.

It is necessary to set the pH of the electrolyte solution to 9 to 13, and it is preferable to set it to 9.5 to 12. When pH is below 9, it results in poor alkaline etching performance of the electrolyte solution, thereby causing the porous aluminum oxide film to have an incomplete porous structure. Meanwhile, when pH is above 13, it results in excessive alkaline etching performance, thereby inhibiting the porous aluminum oxide film from growing and further inhibiting the barrier aluminum oxide film from being formed.

It is necessary to set the electrolyte solution temperature to 35 to 85° C., and it is preferable to set it to 40 to 70° C. When the electrolyte solution temperature is below 35° C., it results in poor alkaline etching performance, thereby causing the porous aluminum oxide film to have an incomplete porous structure. Meanwhile, when the electrolyte solution temperature is above 85° C., it results in excessive alkaline etching performance, thereby inhibiting both the porous aluminum oxide film and the barrier aluminum oxide film from growing.

In alkali alternating-current electrolysis, thickness of the entire oxide film including the porous aluminum oxide film and the barrier aluminum oxide film is controlled based on the quantity of electricity, that is to say, a product of multiplying the current density and the electrolysis time. Basically, the greater the quantity of electricity, the greater the entire oxide film thickness. In this point of view, conditions for alternating-current electrolysis of the porous aluminum oxide film and the barrier aluminum oxide film are determined as follows.

Frequency used herein is set to 10 to 100 Hz and preferably 20 to 90 Hz. When the frequency is below 10 Hz, electrolysis tends to become direct-current electrolysis. As a result, a porous structure formation of the porous aluminum oxide film does not progress, thereby causing the porous aluminum oxide film to have a dense structure. Meanwhile, when the frequency is above 100 Hz, reversal of the anode and the cathode takes place too quickly, which causes a significant delay in formation of the entire oxide film. This results in requiring a significantly long time required for both the porous aluminum oxide film and the barrier aluminum oxide film to have a certain thickness.

The current density is set to 4 to 50 $A/dm^2$ and preferably 5 to 45 $A/dm^2$. When the current density is below 4 $A/dm^2$, the barrier aluminum oxide film is exclusively formed on a priority basis, making it impossible to obtain the porous aluminum oxide film. Meanwhile, when the current density is above 50 $A/dm^2$, such excessively high current density makes it difficult to control the thicknesses of the porous aluminum oxide film and the barrier aluminum oxide film, which tends to cause lack of uniformity in treatment.

The electrolysis time is set to 5 to 300 seconds and preferably 10 to 240 seconds. The term "electrolysis time" as used herein refers to a period of time during which a certain position of the aluminum material 5 that is transferred in the electrolyte solution 4 is opposed to the surface of the counter electrode 6 in FIG. 1. As illustrated in FIG. 1, L (mm) denotes the length of the counter electrode 6 disposed along with a direction c for feeding the aluminum material 5 and v (mm/sec.) denotes the speed of feeding the aluminum material 5, L/v (sec.) denotes the electrolysis time. When the electrolysis time is shorter than 5 seconds during the treatment time, the porous aluminum oxide film and the barrier aluminum oxide film are formed too quickly, which results in incomplete formation of both oxide films and oxide films including amorphous aluminum oxide.

Meanwhile, the electrolysis time is longer than 300 seconds, it might cause the porous aluminum oxide film and the barrier aluminum oxide film to become too thick or to be redissolved and it might also cause reduction of productivity.

Requirements particular to treatment in which an aluminum material and a counter electrode are continuously energized are specified to enable the time, which is required for the current density in the electrolytically treated aluminum material portion to reach below 1 A/dm$^2$ after the elapse of the above electrolysis time, to be set to 10.0 seconds and preferably not more than 5.0 seconds. The time is most preferably 0 second. As stated below, when the time is longer than 10.0 seconds or specifically when the electrolytically treated aluminum material portion continues to be charged with a relatively weak current even after the termination of electrolysis, cracks tend to be generated in a boundary between the porous aluminum oxide film and the barrier aluminum oxide film.

This is because when a weak current continues to pass transiently after the termination of electrolysis, the current causes an unstable oxide film to be formed immediately below the porous aluminum oxide film, which results in partial cohesive failure due to slight stress. The reason why the current density is allowed to reach below 1 A/dm$^2$ is that when the current density reaches below 1 A/dm$^2$, substantially no unstable oxide film is formed, thereby preventing the occurrence of generation of boundary cracks described above. Note that the above generation of cracks means formation of the above unstable oxide film formed in the boundary between the porous aluminum oxide film and the barrier aluminum oxide film, in which cohesive failure has occurred.

The above transient change in the current density cannot be directly measured; however, it can be calculated based on the configuration of the electrolysis facility. Specifically, as illustrated in FIG. 1, when b (mm) denotes a distance between one end of the counter electrode 6 disposed along with the direction for feeding the aluminum material 5 and one end of the electrolyzer disposed along with the same direction, I denotes a given current density upon electrolysis, and v (mm/sec.) denotes the speed of feeding the aluminum material, time required for the current density to reach below 1 A/dm$^2$ can be estimated as $\{b(I-1)/vI\}$(sec.). Here, I is set to be in a range of 4 to 50 A/dm$^2$ as described above, which means that b and v each can be appropriately set so that $\{b(I-1)/vI\}$ becomes not more than 10.0 seconds. Note that when b is excessively increased or v is excessively decreased, it becomes difficult to avoid crack generation based on the above mechanism.

When the time required for the current density to reach below 1 A/dm$^2$ is set to not more than 10.0 seconds, the length of cracks in the boundary between the porous aluminum oxide film and the barrier aluminum oxide film can be reduced to not more than 50% and preferably not more than 30% of the boundary length. In addition, this percentage is most preferably 0%. However, it is desirable to remove the aluminum material from the electrolyte solution as soon as possible after the current density reaches below 1 A/dm$^2$. In other words, since the electrolyte solution is an alkaline solution, when the aluminum material continues to be immersed in the electrolyte solution even after the termination of electrolysis, it causes the oxide film to be dissolved, which might make it impossible to achieve a certain film thickness.

In the manufacturing method according to the present disclosure, the concentration of dissolved aluminum contained in the electrolyte solution may be controlled to be preferably 5 ppm to 1000 ppm and more preferably 10 ppm to 900 ppm in order to reduce a variation in the oxide film thickness. When the dissolved aluminum concentration is below 5 ppm, an oxide film formation reaction is induced quickly in an early stage of an electrolysis reaction, the dissolved aluminum concentration is likely to be affected by fluctuating factors in the treatment step (such as the state of aluminum material surface contamination and the state of attachment of the aluminum material). As a result, a thick oxide film is locally formed. Meanwhile, when the dissolved aluminum concentration is above 1000 ppm, the viscosity of the electrolyte solution increases, thereby preventing uniform convection in the vicinity of the aluminum material surface in the electrolysis step, and at the same time, dissolved aluminum acts to prevent film formation. As a result, a thin oxide film is locally formed.

One electrode of a pair of electrodes used for alternating-current electrolytic treatment is of an aluminum material that should be electrolytically treated. A known electrode made of graphite, aluminum, titanium, or the like can be used as the other counter electrode, with the proviso that, according to the present disclosure, it is necessary to use an electrode made of a material that does not deteriorate against the alkaline components and temperature of the electrolyte solution, has excellent electrical conductivity, and does not induce an electrochemical reaction by itself. In these points of view, a graphite electrode is preferably used as the counter electrode. This is because a graphite electrode is chemically stable and can be obtained at a reasonable price, and many pores present in the graphite electrode act to allow lines of electric force to be drawn at adequate intervals in the alternating-current electrolysis step, which tends to make uniform formation of both the porous aluminum oxide film and the barrier aluminum oxide film.

C. Oxide Film

A surface-side porous aluminum oxide film and a base-side barrier aluminum oxide film are formed on the surface of the aluminum material used in the present disclosure. In other words, an oxide film comprising the two layers, which are the porous aluminum oxide film and the barrier aluminum oxide film, is formed on the surface of the aluminum material. The porous aluminum oxide film exhibits strong adhesiveness or adhesion while the entire aluminum oxide film and the aluminum serving as a base are strongly bonded with each other via the barrier aluminum oxide film. Further, it is possible to prevent detachment of the porous aluminum oxide film by allowing the length of cracks formed in the boundary between the porous aluminum oxide film and the barrier aluminum oxide film to be not more than 50% of the boundary length.

C-1. Porous Aluminum Oxide Film

Thickness of the porous aluminum oxide film is 20 to 500 nm and preferably 50 to 400 nm. When the thickness is below 20 nm, it is insufficient, and therefore, formation of a small pore structure described below tends to become insufficient, resulting in reduction of adhesivity or adhesion strength. Meanwhile, when it is above 500 nm, cohesive failure is likely to occur in the porous aluminum oxide film itself, resulting in reduction of adhesivity or adhesion strength.

The porous aluminum oxide film has small pores in the depth direction from its surface. Small pores each have a diameter of 5 to 30 nm and preferably 10 to 20 nm. Such small pores increase an area of contact between the resin layer, the adhesive, or the like and the aluminum oxide film, thereby exhibiting the effect of increasing adhesivity or adhesion strength therebetween. When the small pore diameter is below 5 nm, the area of contact excessively decreases, thereby making it impossible to achieve sufficient adhesivity or adhesion strength. Meanwhile, when the small pore diameter is above 30 nm, the entire porous aluminum oxide film itself becomes fragile, thereby inducing cohesive failure and leading to reduction of adhesivity or adhesion strength.

The percentage of the total pore area of small pores with respect to the area of the porous aluminum oxide film is not particularly limited. The percentage of the total pore area of small pores with respect to an apparent area of the porous aluminum oxide film (area represented by a product of multiplying the length by the width regardless of fine concavity and convexity or the like on the surface) is preferably 25 to 75% and more preferably 30 to 70%. When it is below 25%, the area of contact excessively decreases, thereby making it impossible to achieve sufficient adhesivity or adhesion strength. Meanwhile, when it is above 75%, the entire porous aluminum oxide film itself becomes fragile, thereby inducing cohesive failure and leading to reduction of adhesivity or adhesion strength in some cases.

C-2. Barrier Aluminum Oxide Film

Thickness of the barrier aluminum oxide film is 3 to 30 nm and preferably 5 to 25 nm. When it is below 3 nm, the barrier aluminum oxide film serving as an intermediate layer cannot impart binding force sufficient for binding between the porous aluminum oxide film and the aluminum base, and in particular, binding force in a severe environment such as a high-temperature/high-humidity environment. Meanwhile, when the thickness of the barrier aluminum oxide film is above 30 nm, cohesive failure tends to be induced in the barrier aluminum oxide film due to the dense structure of the barrier aluminum oxide film, which in turn causes reduction of adhesivity or adhesion strength.

C-3. Cracks Formed in the Boundary Between the Porous Aluminum Oxide Film and the Barrier Aluminum Oxide Film Desirably, the oxide films specified in C-1 and C-2 are continuously formed. The length of cracks formed between the oxide films needs to be not more than 50%, not preferably not more than 30%, and most preferably 0% of the full length of the boundary. Such percentage of the crack length with respect to the full length of the boundary is achieved in relation to electrolysis conditions that enable time, which is required for the current density in the electrolytically treated aluminum material portion to reach below 1 $A/dm^2$ after the elapse of electrolysis time, to be set to not more than 10.0 seconds. When the above percentage is above 50%, detachment of the oxide films as a whole can be easily caused by the cracks, resulting in significant reduction of adhesiveness to resins. Here, the percentage of the crack length with respect to the full length of the boundary is determined in the manner specified below. In other words, the above cracks correspond to partial cohesive failure of an unstable oxide film, which originates from current attenuation behavior after the elapse of the electrolysis time, the cohesive failure occurring in parallel to the boundary between the porous aluminum oxide film and the barrier aluminum oxide film. The percentage of the crack length (m) with respect to the full length of the boundary (M) can be designated as a value (m/M) based on TEM cross-section observation or the like described below.

C-4. Range of Variation in the Entire Oxide Film Thickness

The range of variation in the entire oxide film thickness, which is the total thickness of the porous aluminum oxide film described in C-1 and the barrier aluminum oxide film described in C-2, is preferably within ±50% and more preferably within ±20% regardless of the site of measurement of the preferable aluminum material. In other words, when T (nm) denotes an arithmetic mean of the entire oxide film thickness measured at a plurality of arbitrary sites on the aluminum material surface (desirably not less than 10 sites, at which not less than 10 measurement points are desirable), it is preferable for the entire oxide film thickness at the plurality of measurement sites to fall within a range of (0.5×T) to (1.5×T). When there is a site at which the thickness is below (0.5×T), the oxide film becomes thinner at the site than the surrounding sites. In such case, a gap is likely to be generated between the oxide film and an adhesive to be used for adhesion or a resin layer to be adhered to the oxide film at the site of thinning of the oxide film, which may result in an insufficient area of contact and lead to reduction of adhesivity or adhesion strength. Meanwhile, there is a site at which the thickness is above (1.5×T), the oxide film becomes thicker at the site than the surrounding sites. In such case, stress from the resin layer to be adhered to the oxide film is concentrated at the site of thickening of the oxide film, which may induce cohesive failure in oxide film and lead to reduction of adhesivity or adhesion strength.

At the site of thinning or thickening of the entire oxide film thickness described above, optical characteristics differ from those at the surrounding sites, which may allow visual judgment of color change such as reddish-brown or a white cloudy.

D. Means for Observing the Oxide Film

Cross-section observation by a transmission electron microscope (TEM) is preferably used for structure observation and thickness measurement of the porous aluminum oxide film and the barrier aluminum oxide film and measurement of the length of cracks formed in the boundary between the porous aluminum oxide film and the barrier aluminum oxide film according to the present disclosure. Specifically, thin samples are prepared by cutting the oxide films in a direction perpendicular to the thickness direction by an ultramicrotome, a focused ion beam (FIB) processing device, or the like. Next, each sample is observed by TEM. In preparation of thin samples, since a subject of observation might have cracks, it is more preferable to use an FIB processing device. In addition, in crack length measurement and percentage calculation, quantitative determination can be performed by setting a magnification for TEM to a low level (a magnification of about 5000 to 10000) and observing a plurality of fields of view.

E. Bonded Body of a Surface-Treated Aluminum Material and a Resin

A surface-treated aluminum material manufactured in the above manner can be used for various applications when the surface on which an oxide film has been formed is further covered with a resin by making use of excellent adhesiveness thereof. The resin that can be used herein may be either a thermosetting resin or a thermoplastic resin. A variety of effects can be achieved by the resin used in combination with a specific oxide film formed on the treated surface of the surface-treated aluminum material according to the present disclosure.

For example, regarding a bonded body of an aluminum material and a resin, since the coefficient of thermal expansion of a resin is usually greater than that of an aluminum material, peeling or cracking tends to occur in the interface. However, regarding the bonded body of a surface-treated aluminum material and a resin according to the present disclosure, the oxide film is very thin and has a particular shape as described above, and thus, it has excellent flexibility, easily accommodates expansion of the resin, and is unlikely to experience peeling or cracking. Therefore, the bonded body of a surface-treated aluminum material and a thermoplastic resin according to the present disclosure can be preferably used as a lightweight and highly rigid composite material. In addition, the bonded body of a surface-treated aluminum material and a thermoplastic resin according to the present disclosure can be preferably used for a printed circuit board.

A variety of thermoplastic resins and thermosetting resins can be used as the above resin. Specifically, a resin layer of a thermoplastic resin can be formed by allowing a heated resin in a fluid state to come into contact with or impregnate into a porous aluminum oxide film and cooling the resulting product for solidification. Examples of the thermoplastic resin that can be used include polyolefins (such as polyethylene and polypropylene), polyvinyl chloride, polyesters (such as polyethylene terephthalate and polybutylene terephthalate), polyamide, polyphenylenesulfide, aromatic polyetherketones (such as polyetheretherketone and polyetherketone), polystyrene, a variety of fluororesins (such as polytetrafluoroethylene and polychlorotrifluoroethylene), acrylic resins (such as polymethyl methacrylate), ABS resin, polycarbonate, and thermoplastic polyimide.

In addition, a thermosetting resin in a fluid state before curing is allowed to come into contact with or impregnate into a porous aluminum oxide film, followed by curing. Examples of the thermosetting resin that can be used include phenol resin, epoxy resin, melamine resin, urea resin, unsaturated polyester resin, alkyd resin, polyurethane, and thermosetting polyimide.

Each of the thermoplastic resin and the thermosetting resin described above may be used individually or in the form of a polymer alloy containing a mixture of different types of thermoplastic resins or different types of thermosetting resins. In addition, it is also possible to improve physical properties such as strength and the coefficient of thermal expansion of a resin by adding a variety of fillers. Specifically, fillers of known substances including a variety of fibers such as glass fiber, carbon fiber, and aramid fiber, calcium carbonate, magnesium carbonate, silica, talc, glass, and clay can be used.

EXAMPLES

Preferred embodiments of the present disclosure will be described in more detail below with reference to the Examples.

Examples 1 to 24 and Comparative Examples 1 to 12

A coiled JIS5052-H34 alloy plate having a width of 200 mm×a plate thickness of 1.0 mm was used as an aluminum material. This aluminum alloy plate was used as one electrode and a flat-shaped graphite plate having a width of 300 mm×a length of 10 mm×a plate thickness of 2.0 mm was used as a counter electrode. As illustrated in FIG. 1, both electrodes were arranged in an electrolyte solution 4 placed in an electrolyzer 1 so that one face of an aluminum alloy plate 5 was arranged to be opposed to a counter electrode 6, thereby allowing a surface-side porous aluminum oxide film and a base-side barrier aluminum oxide film to be formed on the one face opposed to the counter electrode 6. An alkaline aqueous solution containing sodium pyrophosphate as a major component was used as the electrolyte solution 4. The alkaline component concentration of the electrolyte solution was adjusted to 0.5 mol/L, and pH was adjusted with a hydrochloric acid aqueous solution and a sodium hydroxide aqueous solution (each at a concentration of 0.1 mol/L). Alternating-current electrolytic treatment was conducted under electrolysis conditions listed in Tables 1 and 2. Thus, test materials, each on which a porous aluminum oxide film and a barrier aluminum oxide film had been formed, were prepared. The electrolysis time was adjusted by changing the counter electrode length and the material feeding speed. Tables 1 and 2 also list the interelectrode distance a between each aluminum material electrode and its counter electrode.

TABLE 1

| | Electrolyte solution | | | Electrolytic treatment conditions | | | Continuous treatment facility configuration | | | |
|---|---|---|---|---|---|---|---|---|---|---|
| | pH [—] | Temperature [° C.] | Dissolved Al level [ppm] | Frequency [Hz] | Current density [A/dm$^2$] | Electrolysis time [sec.] | Interelectrode distance a [mm] | Distance b between the counter electrode end and the electrolyzer end [mm] | Feeding speed v [mm/sec.] | Time required for the current density to reach below 1 A/dm$^2$ [sec.] |
| Example 1 | 11.0 | 60 | 50 | 50 | 10 | 30 | 10 | 100 | 10 | 9.0 |
| Example 2 | 9.5 | 60 | 50 | 50 | 10 | 30 | 10 | 100 | 10 | 9.0 |
| Example 3 | 12.5 | 60 | 50 | 50 | 10 | 30 | 10 | 100 | 10 | 9.0 |
| Example 4 | 11.0 | 40 | 50 | 50 | 10 | 30 | 10 | 100 | 10 | 9.0 |
| Example 5 | 11.0 | 80 | 50 | 50 | 10 | 30 | 10 | 100 | 10 | 9.0 |
| Example 6 | 11.0 | 60 | 50 | 15 | 10 | 30 | 10 | 100 | 10 | 9.0 |
| Example 7 | 11.0 | 60 | 50 | 95 | 10 | 30 | 10 | 100 | 10 | 9.0 |
| Example 8 | 11.0 | 60 | 50 | 50 | 5 | 30 | 10 | 100 | 10 | 8.0 |
| Example 9 | 11.0 | 60 | 50 | 50 | 45 | 15 | 10 | 100 | 10 | 9.8 |
| Example 10 | 11.0 | 60 | 50 | 50 | 10 | 7 | 10 | 100 | 20 | 4.5 |
| Example 11 | 11.0 | 60 | 50 | 50 | 10 | 295 | 10 | 100 | 10 | 9.0 |
| Example 12 | 11.0 | 60 | 50 | 50 | 10 | 30 | 10 | 50 | 10 | 4.5 |
| Example 13 | 11.0 | 60 | 50 | 50 | 10 | 30 | 10 | 100 | 20 | 4.5 |
| Example 14 | 11.0 | 60 | 50 | 50 | 10 | 30 | 10 | 0 | 10 | 0.0 |
| Example 15 | 11.0 | 60 | 10 | 50 | 10 | 30 | 10 | 100 | 10 | 9.0 |
| Example 16 | 11.0 | 60 | 200 | 50 | 10 | 30 | 10 | 100 | 10 | 9.0 |
| Example 17 | 11.0 | 60 | 500 | 50 | 10 | 30 | 10 | 100 | 10 | 9.0 |
| Example 18 | 11.0 | 60 | 900 | 50 | 10 | 30 | 10 | 100 | 10 | 9.0 |
| Example 19 | 11.0 | 60 | 3 | 50 | 10 | 30 | 10 | 100 | 10 | 9.0 |
| Example 20 | 11.0 | 60 | 1100 | 50 | 10 | 30 | 10 | 100 | 10 | 9.0 |

TABLE 1-continued

| | Electrolyte solution | | | Electrolytic treatment conditions | | | Continuous treatment facility configuration | | | |
|---|---|---|---|---|---|---|---|---|---|---|
| | pH [—] | Temperature [° C.] | Dissolved Al level [ppm] | Frequency [Hz] | Current density [A/dm$^2$] | Electrolysis time [sec.] | Inter-electrode distance a [mm] | Distance b between the counter electrode end and the electrolyzer end [mm] | Feeding speed v [mm/sec.] | Time required for the current density to reach below 1 A/dm$^2$ [sec.] |
| Example 21 | 11.0 | 60 | 50 | 50 | 10 | 30 | 2 | 100 | 10 | 9.0 |
| Example 22 | 11.0 | 60 | 50 | 50 | 10 | 30 | 5 | 100 | 10 | 9.0 |
| Example 23 | 11.0 | 60 | 50 | 50 | 10 | 30 | 100 | 100 | 10 | 9.0 |
| Example 24 | 11.0 | 60 | 50 | 50 | 10 | 30 | 150 | 100 | 10 | 9.0 |

TABLE 2

| | Electrolyte solution | | | Electrolytic treatment conditions | | | Continuous treatment facility configuration | | | |
|---|---|---|---|---|---|---|---|---|---|---|
| | pH [—] | Temperature [° C.] | Dissolved Al level [ppm] | Frequency [Hz] | Current density [A/dm$^2$] | Electrolysis time [sec.] | Inter-electrode distance a [mm] | Distance b between the counter electrode end and the electrolyzer end [mm] | Feeding speed v [mm/sec.] | Time required for the current density to reach below 1 A/dm$^2$ [sec.] |
| Comparative Example 1 | 8.5 | 60 | 50 | 50 | 10 | 30 | 10 | 100 | 10 | 9.0 |
| Comparative Example 2 | 13.5 | 60 | 50 | 50 | 10 | 30 | 10 | 100 | 10 | 9.0 |
| Comparative Example 3 | 11.0 | 30 | 50 | 50 | 10 | 30 | 10 | 100 | 10 | 9.0 |
| Comparative Example 4 | 11.0 | 90 | 50 | 50 | 10 | 30 | 10 | 100 | 10 | 9.0 |
| Comparative Example 5 | 11.0 | 60 | 50 | 8 | 10 | 30 | 10 | 100 | 10 | 9.0 |
| Comparative Example 6 | 11.0 | 60 | 50 | 120 | 10 | 30 | 10 | 100 | 10 | 9.0 |
| Comparative Example 7 | 11.0 | 60 | 50 | 50 | 3 | 30 | 10 | 100 | 10 | 6.7 |
| Comparative Example 8 | 11.0 | 60 | 50 | 50 | 55 | 30 | 10 | 100 | 10 | 9.8 |
| Comparative Example 9 | 11.0 | 60 | 50 | 50 | 10 | 3 | 10 | 100 | 20 | 4.5 |
| Comparative Example 10 | 11.0 | 60 | 50 | 50 | 10 | 305 | 10 | 100 | 10 | 9.0 |
| Comparative Example 11 | 11.0 | 60 | 50 | 50 | 10 | 30 | 10 | 100 | 8 | 11.0 |
| Comparative Example 12 | 11.0 | 60 | 50 | 50 | 10 | 30 | 10 | 150 | 10 | 13.5 |

Cross-section observation was conducted for the test materials prepared above using TEM. For TEM cross-section observation, in order to measure the thicknesses of the porous aluminum oxide film and the barrier aluminum oxide film, the diameter of small pores on the porous aluminum oxide film, and the length of cracks generated in the boundary between the porous aluminum oxide film and the barrier aluminum oxide film, 10 thin samples for cross-section observation were prepared from each test material using an FIB processing device.

The thicknesses of the porous aluminum oxide film and the barrier aluminum oxide film and the diameter of small pores of the porous aluminum oxide film were each determined to be an arithmetic mean value of 100 measured values in total obtained for each sample based on measurement results of arbitrary 10 points selected for each of the above samples. The length of cracks was also determined to be an arithmetic mean value of 100 measured values in total obtained for each sample based on measurement results of arbitrary 10 points selected for each of the above samples. In addition, in measurement of the length of cracks, the field of view of TEM was designated as having a size of 1 μm×1 μm. As stated above, the length of cracks determined in such manner was divided by the length of a boundary between the porous aluminum oxide film and the barrier aluminum oxide film, and the resultant was designated as the crack length percentage. Further, for determination of variation in the entire oxide film thickness (total thickness of the porous aluminum oxide film and the barrier aluminum oxide film), the number of measurement points each corresponding to a measured value within a range of 50% to 150% of the relevant arithmetic mean value among the above 100 measurement points (10 samples×10 measurement points) was recorded. Tables 3 and 4 list the results.

TABLE 3

| | Oxide film structure | | | | |
|---|---|---|---|---|---|
| | Porous aluminum oxide film thickness [nm] | Barrier aluminum oxide film thickness [nm] | Small pore diameter [nm] | Crack length percentage [%] | Number of measurement points for the oxide film thickness corresponding to a measured value within a range of 50% to 150% of the arithmetic mean value [—] |
| Example 1 | 220 | 10 | 10 | 35 | 100 |
| Example 2 | 180 | 10 | 7 | 35 | 100 |
| Example 3 | 95 | 10 | 30 | 30 | 100 |
| Example 4 | 230 | 25 | 5 | 35 | 100 |
| Example 5 | 135 | 7 | 20 | 30 | 100 |
| Example 6 | 180 | 25 | 15 | 35 | 100 |
| Example 7 | 80 | 7 | 7 | 25 | 100 |
| Example 8 | 35 | 5 | 10 | 20 | 100 |
| Example 9 | 480 | 20 | 15 | 45 | 100 |
| Example 10 | 25 | 4 | 10 | 25 | 100 |
| Example 11 | 480 | 20 | 15 | 40 | 100 |
| Example 12 | 210 | 10 | 10 | 10 | 100 |
| Example 13 | 210 | 10 | 10 | 10 | 100 |
| Example 14 | 220 | 10 | 10 | 0 | 100 |
| Example 15 | 220 | 10 | 10 | 30 | 100 |
| Example 16 | 210 | 10 | 10 | 30 | 100 |
| Example 17 | 220 | 10 | 10 | 30 | 100 |
| Example 18 | 210 | 10 | 10 | 35 | 100 |
| Example 19 | 210 | 10 | 10 | 30 | 60 |
| Example 20 | 210 | 10 | 10 | 35 | 45 |
| Example 21 | 270 | 15 | 15 | 40 | 100 |
| Example 22 | 250 | 12 | 12 | 35 | 100 |
| Example 23 | 195 | 8 | 9 | 40 | 100 |
| Example 24 | 170 | 5 | 7 | 45 | 100 |

TABLE 4

| | Oxide film structure | | | | |
|---|---|---|---|---|---|
| | Porous aluminum oxide film thickness [nm] | Barrier aluminum oxide film thickness [nm] | Small pore diameter [nm] | Crack length percentage [%] | Number of measurement points for the oxide film thickness corresponding to a measured value within a range of 50% to 150% of the arithmetic mean value [—] |
| Comparative Example 1 | 85 | 20 | 2 | 30 | 100 |
| Comparative Example 2 | 15 | 2 | 35 | 10 | 55 |
| Comparative Example 3 | 70 | 25 | 3 | 20 | 100 |
| Comparative Example 4 | 15 | 2 | 30 | 5 | 40 |
| Comparative Example 5 | 0 | 75 | 0 | 25 | 80 |
| Comparative Example 6 | 15 | 3 | 15 | 5 | 30 |
| Comparative Example 7 | 15 | 25 | 15 | 5 | 66 |
| Comparative Example 8 | 560 | 35 | 20 | 50 | 100 |
| Comparative Example 9 | 10 | 2 | 5 | 5 | 25 |
| Comparative Example 10 | 585 | 35 | 25 | 50 | 100 |

TABLE 4-continued

| | Oxide film structure | | | | |
|---|---|---|---|---|---|
| | Porous aluminum oxide film thickness [nm] | Barrier aluminum oxide film thickness [nm] | Small pore diameter [nm] | Crack length percentage [%] | Number of measurement points for the oxide film thickness corresponding to a measured value within a range of 50% to 150% of the arithmetic mean value [—] |
| Comparative Example 11 | 220 | 10 | 10 | 55 | 100 |
| Comparative Example 12 | 220 | 10 | 10 | 65 | 100 |

The above test materials were evaluated for adhesiveness by the following method using an adhesive.

[Primary Adhesion Test]

Each of the above test materials was cut to obtain two sheets each having a length of 50 mm and a width of 25 mm. These two sheets of each test material were aligned in parallel to each other along with the overall width direction while they were allowed to overlap with each other in the length direction by 10 mm. The overlapping portions were bonded with a commercially available two-pack epoxy adhesive (Nichiban Co., Ltd.; Araldite Rapid; Model No.: AR-R30; weight mix ratio=base resin: 100/curing agent: 100). Thus, a shear test piece was prepared. Both ends in the length direction of the shear test piece were pulled in opposite directions along with the length direction using a tensile tester at a rate of 100 mm/minute. Adhesiveness was evaluated in accordance with the following criteria based on the load (converted into shear stress) and the status of peeling. Note that 10 sets of shear test pieces were obtained from each test material and separately evaluated.

○: State in which the shear stress is not less than 20 $N/mm^2$ and cohesive failure is observed in the adhesive layer itself.

Δ: State in which although the shear stress is not less than 20 $N/mm^2$, interface separation between the adhesive layer and the test material is observed x: State in which the shear stress is less than 20 $N/mm^2$ and interface separation between the adhesive layer and the test material is observed Tables 5 and 6 show the results. The number of sets corresponding to any of "○", "Δ" and "x" among 10 sets of shear test pieces is listed in Tables 5 and 6. In a case in which all 10 sets of shear test pieces of a test material were judged as "○", the test material was evaluated as "Pass," and in the other cases, it was evaluated as "Fail."

TABLE 5

| | Primary adhesion test | | | |
|---|---|---|---|---|
| | ○ | Δ | x | Evaluation |
| Example 1 | 10 | 0 | 0 | Pass |
| Example 2 | 10 | 0 | 0 | Pass |
| Example 3 | 10 | 0 | 0 | Pass |
| Example 4 | 10 | 0 | 0 | Pass |
| Example 5 | 10 | 0 | 0 | Pass |
| Example 6 | 10 | 0 | 0 | Pass |
| Example 7 | 10 | 0 | 0 | Pass |

TABLE 5-continued

| | Primary adhesion test | | | |
|---|---|---|---|---|
| | ○ | Δ | x | Evaluation |
| Example 8 | 10 | 0 | 0 | Pass |
| Example 9 | 10 | 0 | 0 | Pass |
| Example 10 | 10 | 0 | 0 | Pass |
| Example 11 | 10 | 0 | 0 | Pass |
| Example 12 | 10 | 0 | 0 | Pass |
| Example 13 | 10 | 0 | 0 | Pass |
| Example 14 | 10 | 0 | 0 | Pass |
| Example 15 | 10 | 0 | 0 | Pass |
| Example 16 | 10 | 0 | 0 | Pass |
| Example 17 | 10 | 0 | 0 | Pass |
| Example 18 | 10 | 0 | 0 | Pass |
| Example 19 | 10 | 0 | 0 | Pass |
| Example 20 | 10 | o | 0 | Pass |
| Example 21 | 10 | 0 | 0 | Pass |
| Example 22 | 10 | 0 | 0 | Pass |
| Example 23 | 10 | 0 | 0 | Pass |
| Example 24 | 10 | 0 | 0 | Pass |

TABLE 6

| | Primary adhesion test | | | |
|---|---|---|---|---|
| | ○ | Δ | x | Evaluation |
| Comparative Example 1 | 0 | 4 | 6 | Fail |
| Comparative Example 2 | 0 | 3 | 7 | Fail |
| Comparative Example 3 | 0 | 5 | 5 | Fail |
| Comparative Example 4 | 0 | 6 | 4 | Fail |
| Comparative Example 5 | 0 | 0 | 10 | Fail |
| Comparative Example 6 | 0 | 1 | 9 | Fail |
| Comparative Example 7 | 0 | 1 | 9 | Fail |
| Comparative Example 8 | 0 | 6 | 4 | Fail |
| Comparative Example 9 | 0 | 0 | 10 | Fail |
| Comparative Example 10 | 0 | 5 | 5 | Fail |
| Comparative Example 11 | 0 | 0 | 10 | Fail |
| Comparative Example 12 | 0 | 0 | 10 | Fail |

In each of Examples 1 to 24, the oxide film satisfied requirements of the present disclosure, resulting in the "Pass" evaluation for primary adhesion. On the other hand, in Comparative Examples 1 to 12, the "Fail" evaluation was given for the following reasons.

In Comparative Example 1, pH of the electrolyte solution was excessively low during alternating-current electrolytic treatment, resulting in poor alkaline etching performance. This caused reduction of the diameter of small pores in the porous aluminum oxide film. Therefore, primary adhesion was evaluated as "Fail."

In Comparative Example 2, pH of the electrolyte solution was excessively high during alternating-current electrolytic treatment, resulting in excessive alkaline etching performance. This caused insufficiency of the thicknesses of the porous aluminum oxide film and the barrier aluminum oxide film and excess of the diameter of small pores on the porous aluminum film. Therefore, primary adhesion was evaluated as "Fail."

In Comparative Example 3, the temperature of the electrolyte solution was excessively low during alternating-current electrolytic treatment, resulting in poor alkaline etching performance. This caused the porous aluminum oxide film to have an incomplete porous structure and thus to have an excessively reduced diameter of small pores. Therefore, primary adhesion was evaluated as "Fail."

In Comparative Example 4, the temperature of the electrolyte solution was excessively high during alternating-current electrolytic treatment, resulting in excessive alkaline etching performance. This caused insufficiency of the thicknesses of the porous aluminum film layer and the barrier aluminum oxide film. Therefore, primary adhesion was evaluated as "Fail."

In Comparative Example 5, the frequency was excessively low during alternating-current electrolytic treatment, which caused the electric condition to become close to that of direct-current electrolysis. Thus the formation of porous aluminum oxide film dis not progress and small pores were also not formed, resulting in excess of the thickness of the barrier aluminum oxide film. Therefore, primary adhesion was evaluated as "Fail."

In Comparative Example 6, the frequency was excessively high during alternating-current electrolytic treatment, resulting in excessive acceleration of reversal of the anode and the cathode. This caused an extreme delay in formation of the porous aluminum oxide film and insufficiency of the thickness thereof. Therefore, primary adhesion was evaluated as "Fail."

In Comparative Example 7, the current density was extremely low during alternating-current electrolytic treatment, resulting in preferential barrier aluminum oxide film formation. This caused insufficiency of the thickness of the porous aluminum oxide film. Therefore, primary adhesion was evaluated as "Fail."

In Comparative Example 8, the current density was excessively high during alternating-current electrolytic treatment, resulting in unstable control of electrolytic treatment such as spark generation in the electrolyte solution. This caused excessive formation of the oxide film as a whole, resulting in excess of the thicknesses of the porous aluminum oxide film and the barrier aluminum oxide film. As a result, primary adhesion was evaluated as "Fail."

In Comparative Example 9, the electrolytic treatment time was too short during alternating-current electrolytic treatment, resulting in insufficient formation of the porous aluminum oxide film and the barrier aluminum oxide film. This caused an insufficient thickness of the porous aluminum oxide film and the barrier aluminum oxide film. Therefore, primary adhesion was evaluated as "Fail."

In Comparative Example 10, the electrolytic treatment time was too long during alternating-current electrolytic treatment, resulting in excessive formation of the oxide film as a whole. This caused the porous aluminum oxide film and the barrier aluminum oxide film to be excessively thickened. Therefore, primary adhesion was evaluated as "Fail."

In Comparative Examples 11 and 12, the shapes of the porous aluminum oxide film and the barrier aluminum oxide film met requirements of the present disclosure. However, after the termination of electrolysis, the time required for the current density in the aluminum material to reach below 1 $A/dm^2$ exceeded 10 seconds while the length of cracks formed in the boundary between the porous aluminum oxide film and the barrier aluminum oxide film exceeded 50% of the boundary length. Therefore, temporary adhesion was evaluated as "Fail."

In addition, the number of measurement points, at each of which the oxide film thickness accounted for 50 to 150% of the relevant arithmetic mean value in Table 4, was less than 100 in Comparative Examples 2, 4 to 7, and 9. This is because the oxide film thickness became very thin and oxide film formation was unstable under conditions in these Comparative Examples, which resulted in an increase in the variation of oxide film thickness even at a dissolved Al level of 5 to 1000 ppm.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application is based on Japanese Patent Application No. 2015-159748 filed on Aug. 13, 2015 and Japanese Patent Application No. 2016-145908 filed on Jul. 26, 2016. The specifications, claims, and drawings of Japanese Patent Application No. 2015-159748 and Japanese Patent Application No. 2016-145908 are incorporated herein by reference in its entirety.

INDUSTRIAL APPLICABILITY

According to the present disclosure, a surface-treated aluminum material having excellent adhesiveness and adhesion can be manufactured via continuous treatment with high productivity. Further, a bonded body of the surface-treated aluminum material and a resin is excellent in binding performance.

REFERENCE SIGNS LIST

1 Electrolyzer
2 A pair of rolls arranged at the forward position for feeding into an electrolyzer
3 A pair of rolls arranged at the backward position for feeding out from an electrolyzer
4 Electrolyte solution
5 Aluminum material
6 Counter electrode
7 Alternator b Distance between one end of a counter electrode and one end of an electrolyzer along with the aluminum material feeding direction c Aluminum material feeding direction L Length of a counter electrode along with the aluminum material feeding direction

The invention claimed is:

1. A surface-treated aluminum material having adhesiveness to resins comprising:

an oxide film located on a surface of a coiled aluminum material, the oxide film comprising:

a surface-side porous aluminum oxide film having a thickness of 20 to 500 nm, the surface-side porous aluminum oxide film having small pores, each small pore having a diameter of 5 to 30 nm;

a base-side barrier aluminum oxide film having a thickness of 3 to 30 nm; and a boundary between the surface-side porous aluminum oxide film and the base-side barrier aluminum oxide film, the boundary comprising a crack wherein a length of the crack is less than 50% of a length of the boundary, wherein a thickness of the oxide film comprises the thickness of the surface-side porous aluminum oxide film and the thickness of the base-side barrier aluminum oxide film, and wherein a measured thickness of the oxide film falls within a range of (0.5×T) to (1.5×T) where T is an arithmetic mean of the thickness of the oxide film measured at not less than ten arbitrary sites on the surface-treated aluminum material.

2. A method for manufacturing the surface-treated aluminum material having excellent adhesiveness to resins according to claim 1, comprising conducting alternating-current electrolytic treatment using an electrode made of an aluminum material that is continuously fed and supplied into an electrolyte solution and a fixed counter electrode, the electrolyte solution being an alkaline aqueous solution having a pH of 9 to 13 at a solution temperature of 35 to 85° C., under conditions of a frequency of 10 to 100 Hz, a current density of 4 to 50 A/dm$^2$, and a period of electrolysis time of 5 to 300 seconds, thereby forming an oxide film on the surface of a portion of the aluminum material opposed to the counter electrode, wherein the electrode made of an aluminum material and the counter electrode are continuously energized, and time required for the current density in the electrolytically treated aluminum material portion to reach below 1 A/dm$^2$ after the elapse of the electrolysis time is set to not more than 10.0 seconds.

3. The method for manufacturing the surface-treated aluminum material having excellent adhesiveness to resins according to claim 2, wherein an interelectrode distance between the electrode made of the aluminum material and the counter electrode is 2 to 150 mm.

* * * * *